United States Patent [19]

Speier

[11] Patent Number: 4,771,952

[45] Date of Patent: Sep. 20, 1988

[54] ARTICLE-BREAKING APPARATUS

[76] Inventor: Philip N. Speier, 3623 NE. 1st Ave., Oakland Park, Fla. 33334

[21] Appl. No.: 459,419

[22] Filed: Jan. 20, 1983

[51] Int. Cl.[4] ..... B02C 19/12

[52] U.S. Cl. ..... 241/99; 241/283

[58] Field of Search ..... 241/99, 169, 283, 285 B

[56] References Cited

U.S. PATENT DOCUMENTS

| | | | |
|---|---|---|---|
| 1,559,721 | 11/1925 | Magg | 241/99 X |
| 1,792,841 | 2/1931 | Iglehart | 241/285 B |
| 2,558,255 | 6/1951 | Johnson et al. | 241/36 |
| 2,620,988 | 12/1952 | Tellier | 241/61 |
| 3,756,520 | 9/1973 | Hughes | 241/99 |
| 4,127,236 | 11/1978 | Lasar | 241/285 B X |

FOREIGN PATENT DOCUMENTS

| | | | |
|---|---|---|---|
| 96576 | 4/1924 | Fed. Rep. of Germany | 241/99 |
| 528117 | 10/1976 | U.S.S.R. | 241/99 |

OTHER PUBLICATIONS

"Food Industries", Feb., 1951.

*Primary Examiner*—Howard N. Goldberg
*Assistant Examiner*—Joseph M. Gorski
*Attorney, Agent, or Firm*—Oltman and Flynn

[57] ABSTRACT

For breaking up fluorescent lamp tubes and other frangible articles, a plunger is reciprocated vertically by a manually operated crankshaft on a stand. An elongated tubular guide extends out from the stand and may be raised to an inclined position to feed the lamp tube by gravity beneath the plunger. This guide has top and bottom openings which register respectively with the bottom of a guide sleeve for the vertically reciprocable plunger and the top of an inverted funnel-shaped housing for guiding the broken fragments into a bag suspended from this housing.

7 Claims, 2 Drawing Sheets

ARTICLE-BREAKING APPARATUS

SUMMARY OF THE INVENTION

This invention relates to an apparatus for breaking a fluorescent lamp tube or other elongated frangible article into small fragments which are caught in a disposable container, such as a bag.

Many large buildings, such as office buildings, factories and schools, have such a large number of fluorescent lamp tubes that in any given week several such tubes will be replaced. If the burned-out tubes are stored for trash pickup there is a likelihood that some may be broken accidentally, sometimes with the possibility of injuring a person and always with the certainty that someone will have to sweep up the broken fragments.

The present invention is directed to a simple and safe apparatus for breaking burned-out fluorescent tubes into small fragments and storing the fragments in a disposable bag which is suitable for trash pickup.

A principal object of this invention is to provide a novel apparatus for breaking an elongated article, such as a fluorescent lamp tube, into small particles which are caught in a disposable container, such as a bag.

Another object of this invention is to provide such an apparatus which substantially prevents the escape of any broken fragments while the article is being broken up.

Another object of this invention is to provide such an apparatus which can be operated entirely by hand.

Further objects and advantages of this invention will be apparent from the following description of a presently-preferred embodiment which is illustrated schematically in the accompanying drawings.

Figure 1:
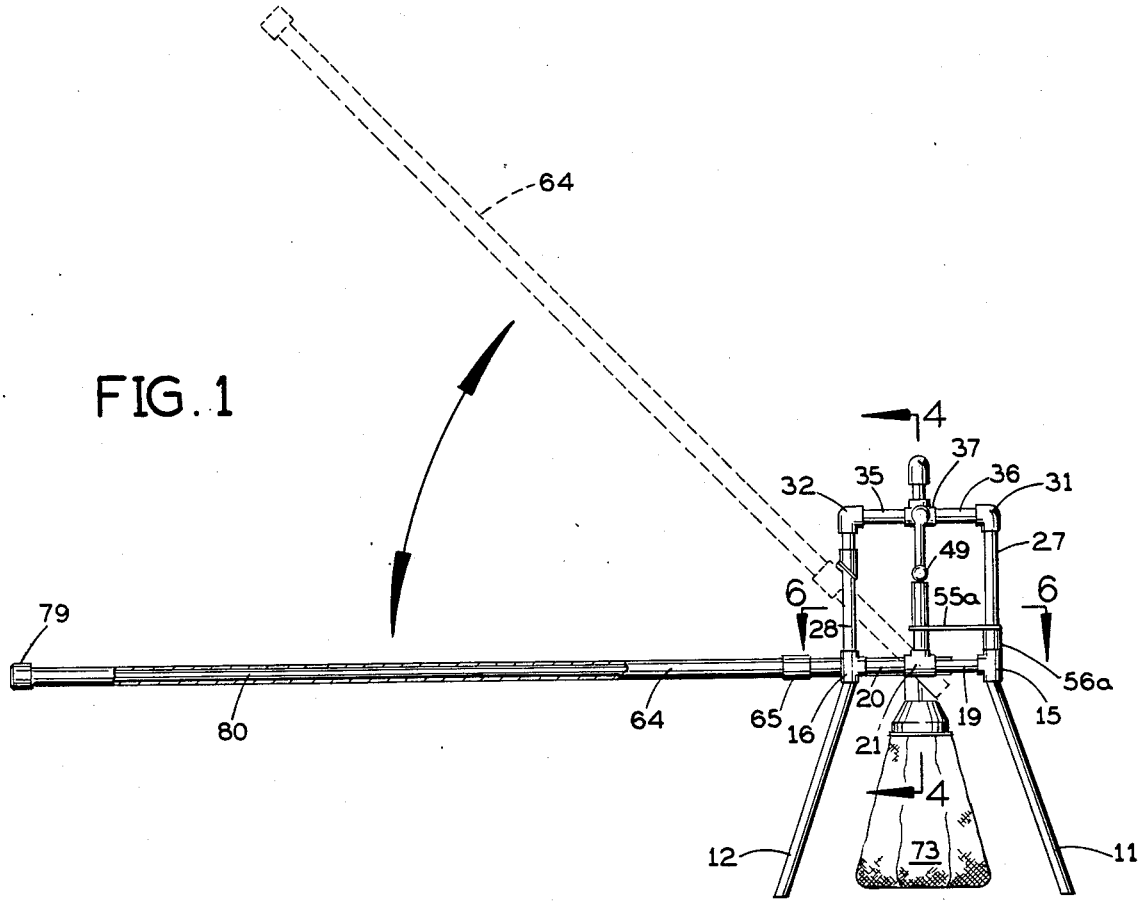
FIG. 1 is a side elevation of the present apparatus.

Before explaining the disclosed embodiment of the present invention in detail, it is to be understood that the invention is not limited in its application to the details of the particular arrangement shown since the invention is capable of other embodiments. Also, the terminology used herein is for the purpose of description and not of limitation.

DETAILED DESCRIPTION

As shown in the drawings, the present apparatus has a support stand having four upwardly and inwardly inclined legs 11, 12, 13 and 14 (FIG. 2) which extend up from the ground or other horizontal support surface. The upper ends of these legs are connected through rigid sockets 15, 16, 17 and 18 (FIGS. 1 and 6) to the four sides of a rectangular generally horizontal frame in the stand. The side of this frame which extends between sockets 15 and 16 has two rigid tubes 19 and 20 connected end-to-end by a T-socket 21. The side which extends between sockets 16 and 17 consists of a single rigid tube 22 of shallow V shape from end to end. The side which extends between sockets 17 and 18 has two rigid tubes 23 and 24 connected end-to-end by a T-socket 25. The fourth side, which extends between sockets 15 and 18, consists of a single rigid tube 26.

The stand also has four rigid vertical tubes 27, 28, 29 and 30 (FIGS. 1, 4 and 5) which extend up from sockets 15, 16, 17 and 18, respectively. Sockets 31, 32, 33 and 34 on the upper ends of these vertical tubes connect them to two opposite horizontal sides of the top of the stand. One of these sides (FIGS. 1 and 2) consists of rigid tubes 35 and 36 connected end to end by a socket 37 and located vertically above the side 19, 20, 21 in the rectangular frame below. The opposite side at the top (FIGS. 2 and 5) consists of rigid tubes 38 and 39 connected end to end by a socket 40 and located vertically above the side 23, 24, 25 in the rectangular frame below.

Figure 4:
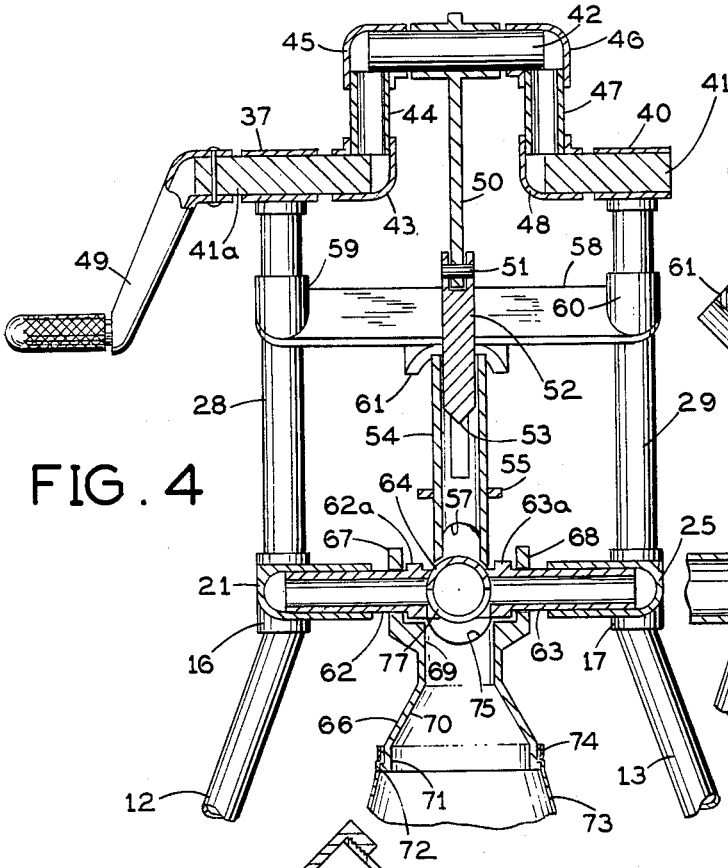
FIG. 4 is a vertical cross-section taken along the line 4—4 in FIG. 1.

As shown in FIG. 4, sockets 37 and 40 rotatably receive the opposite end segments **41*a* and 41*b* of a crankshaft which has an offset middle segment 42 rigidly connected to the end segments 41*a* and 41*b* by elbows and tubes 43, 44, 45, 46, 47 and 48. End segment 41*a* has its outer end connected to a handle 49 which is manually operable to revolve the offset middle segment 42 of the crankshaft about the conjoint axis of its end segments 41*a* and 41*b***.

A connecting rod 50 is rotatably mounted at its upper end on the crank arm 42. At its lower end this connecting rod is pivotally coupled at 51 to the upper end of a plunger 52 having a tapered tip 53 at its lower end. Plunger 52 is slidably received in a vertical guide tube 54 fastened to the inner end of rigid horizontal arms **55*a* and 55*b* (FIG. 6) whose respective outer ends are attached to sleeves 56*a* and 56*b* (FIGS. 1 and 5) which directly 30 overlie sockets 15 and 18 in the stand. The guide tube 54 presents a tapered, elliptical bottom edge 57, as shown in FIGS. 5 and 4, which is inclined downward to the right in FIGS. 1 and 5**.

Figure 5:
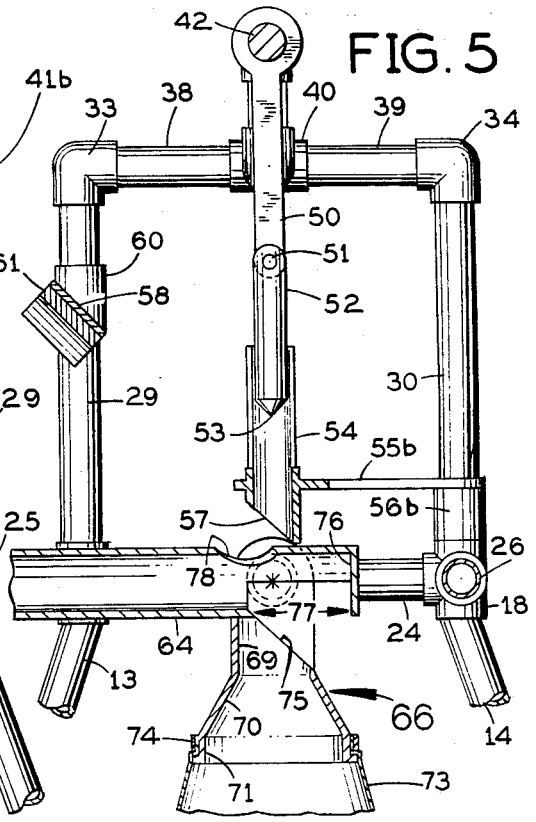
FIG. 5 is a vertical longitudinal section taken along the line 5—5 in FIG. 2.

A stop bar 58 extends horizontally between the vertical tubes 28 and 29 on the left side of the frame in FIGS. 1 and 5. This stop bar is attached to sleeves 59 and 60 on its opposite ends (FIG. 4) which are welded to the vertical tubes 28 and 29, respectively. As best seen in FIG. 5, the stop bar 58 is inclined outward and downward, and on its outer face it carries a resilient pad 61 of rubber or rubber-like material.

Figure 2:
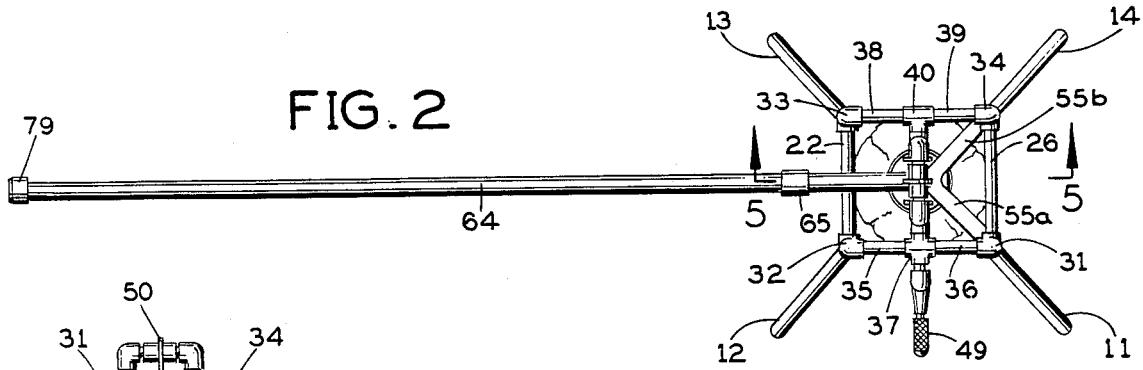
FIG. 2 is a top plan view.
Figure 3:
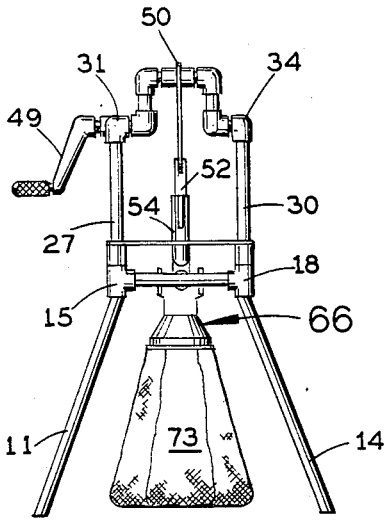
FIG. 3 is an end elevation taken from the right end of FIGS. 1 and 2.
Figure 6:
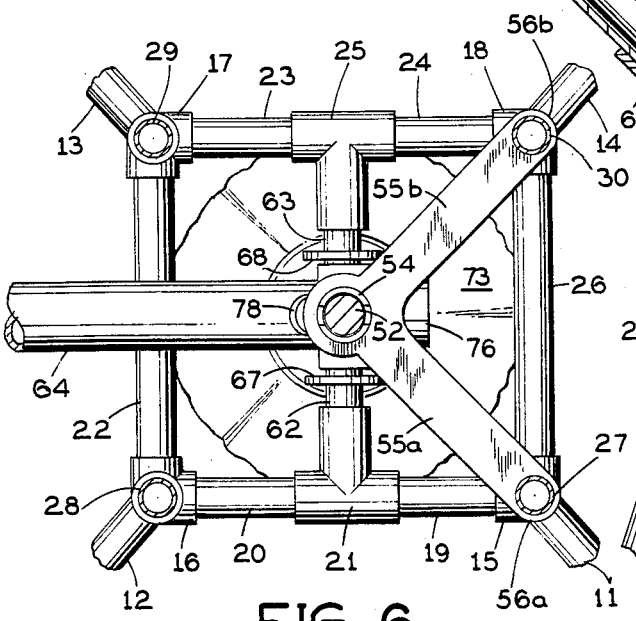
FIG. 6 is a horizontal longitudinal section taken along the line 6—6 in FIG. 1.

As best seen in FIGS. 4 and 6, a rigid, horizontal, tubular rod 62 extends inward from the T-socket 21 and a similar rod 63 extends inward from the T-socket 25 in axial alignment with rod 62. Each of these rods is rotatably received in the corresponding socket. The inner ends of rods 62 and 63 are joined to a rigid tubular guide 64, which extends perpendicular to them across the top of the shallow V tube 22 at one side of the frame. The sockets 21, 25 and rods 62, 63 define a horizontal pivot for guide 64, enabling it to be raised from the horizontal position shown in full lines in FIG. 1 to the inclined position shown in phantom. As shown in FIGS. 1 and 2, guide 64 carries a bumper sleeve 65 which engages the bumper pad 61 on the frame to limit the upward movement of guide 64 to an angle of about 45° to the horizontal.

An inverted, funnel-shaped, annular housing 66 hangs down from the pivot rods 62 and 63 below the tubular guide 64. At its upper end, housing 66 presents upstanding ears 67 and 68 (FIG. 4) with circular openings which pass the pivot rods 62 and 63 loosely. These ears are located just outward from annular flanges 62a and 63a on the pivot rods. Immediately below its suspension ears 67 and 68 the housing 66 presents a vertical opening 69 of circular cross-section which leads down into a frusto-conical passageway 70 whose cross-sectional size increases downward. The lower end of the housing 66 presents a generally cylindrical segment 71 with a horizontal, annular outwardly projecting lip 72 at the bottom. A bag 73 of plastic or other suitable flexible material has its mouth releasably camped around the lower end segment 71 of annular housing 66 by an adjustable strap 74 of known design. Bag 73 hangs down inside the frame at the middle, as shown in FIG. 1.

As shown in FIG. 5, the annular housing 66 is cut away at the top inside its suspension ears 67 and 68, presenting an upwardly-facing, elliptical, tapered ears 75 whose upper end is on the left side of the pivot axis of guide 64 in FIG. 5 and whose lower end is on the right side of this axis.

Figure 7:
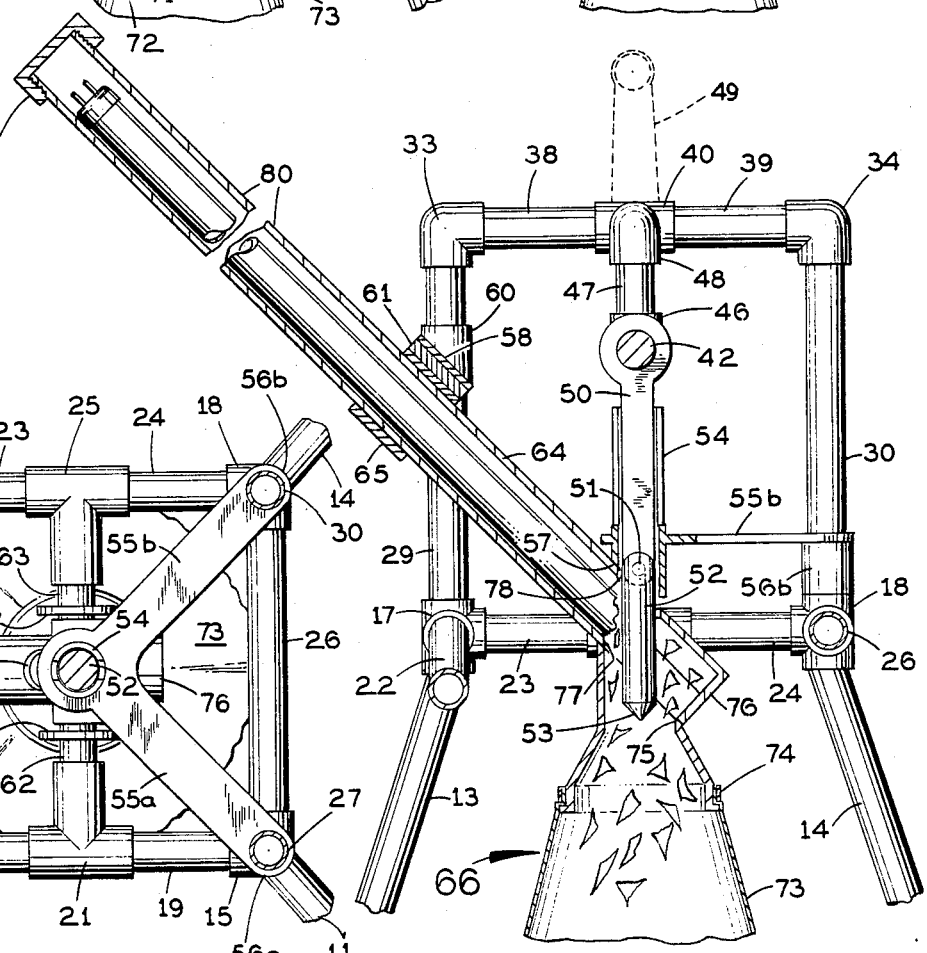
FIG. 7 is a view similar to FIG. 5 showing the frangible article being crushed.

The tubular guide 64 is closed at its right end in FIG. 5, presenting a circular end wall 76 there, and immediately to the left of this end wall it has an elliptical opening 77 in the bottom which registers with the elliptical edge 75 on the top of housing 66 when guide 64 is raised to the inclined position shown in FIG. 7 and in phantom in FIG. 1.

The pivoted tubular guide 64 is formed with an elliptical top opening 74 which registers with the elliptical tapered bottom edge of the plunger guide 54 when guide 64 is raised to the position shown in FIG. 7.

The outer end of guide 64 (the left end in FIG. 1) is externally screw-threaded for the attachment of an internally screw-threaded end cap 79. When this cap is removed and the guide 64 is horizontal, a frangible article, such as a fluorescent lamp 80, may be inserted into the guide 64. This is done when the crank handle 49 is in the position shown in FIG. 4, in which it holds the plunger 52 raised above the lower end of its guide tube 54. Then the guide 64 is tilted up to the phantom-line position in FIG. 1, causing the frangible article to slide down against the inner end wall 76 of guide 64. The handle 49 now is revolved from the position shown in FIG. 4, in which the plunger 52 is raised, to the lowered position shown in FIG. 7. As the handle is revolved, the plunger is forced down through the top opening 78 in guide 64 and smashes the underlying part of the frangible article and then continues down through the bottom opening 77 in guide 64. The particles of glass or other frangible material of article 80 drop down through the annular housing 66 into the bag 73 below.

When the handle 49 is revolved back around to the position shown in FIG. 4, the next section of the frangible article 80 will slide down against the inner end wall 76 of guide 64, so that it is positioned to be broken up in the next downward stroke of plunger 52.

The guide 64 preferably has a length greater than the longest frangible article 80 which it will receive, so that the end cap 79 can be put on guide 64 after the frangible article 80 has been inserted. In one practical embodiment, guide 64 is 8 feet long. However, frangible articles longer than the guide 64 can be accommodated by providing an adapter extension with an end cap.

It will be evident from FIG. 7, that the top opening 78 in guide 64 is sealed around almost its entire periphery by the tapered bottom edge 57 of the plunger guide 54 when guide 64 is raised. Also in this position of guide 64 its bottom opening 77 is sealed around its entire periphery by the tapered top edge 75 of annular housing 66. With this arrangement, the end of the frangible article which is being smashed is virtually totally enclosed and the only place its fragments can go is down into the bag 73.

It will be apparent that the present apparatus provides maximum safety for the person using it, so that he or she is not exposed to flying glass fragments. In addition, the apparatus is completely manually operated, making it inexpensive, simple and safe to use. The top and bottom openings in the guide 64 near its inner end are so located that the plunger 52 cannot be operated to break a frangible article in the guide unless the guide is raised to the position shown in FIG. 7, where broken glass fragments cannot escape.

I claim:

1. An apparatus for breaking a frangible article into fragments comprising:

a stand;

an article breaking member mounted for reciprocation in upward and downward movement in said stand;

means for raising and lowering said article breaking member for breaking the article into broken fragments;

a hollow guide extending into said stand from one side thereof, said guide being mounted on said stand to extend at a downward inclination into the stand beneath said article breaking member, when said member is raised, for gravity-feeding a frangible article beneath said article breaking member to be broken by the downward movement of said article breaking member;

and housing means on said stand to guide the broken fragments of the article down into a receptacle below said article breaking member, the housing means having a top and a bottom;

said guide being pivotally mounted on said stand for adjustment between a raised position in which it has said downward inclination into the stand and a lowered position in which it extends substantially horizontally out from the stand.

2. An apparatus according to claim 1, wherein said guide has a bottom opening which registers with the top of said housing means in said raised position of the guide and a top opening which is vertically above said bottom opening in said raised position of the guide for passing said article breaking member up and down transversely through the guide at said openings.

3. An apparatus according to claim 2, and further comprising a vertical guide sleeve on said stand spaced above said housing means and slidably receiving said article breaking member for vertical reciprocation, said guide sleeve having a bottom opening which registers with said top opening in said guide in said raised position of the latter, the bottom opening having an edge.

4. An apparatus according to claim 3, wherein:

the edge of said bottom opening in said guide sleeve is inclined upward toward said one side of the stand;

and said housing means has a top opening therein spaced vertically below said bottom opening in said guide sleeve and having an inclined edge extending substantially parallel to the edge of said bottom opening in said guide sleeve.

5. An apparatus according to claim 4, wherein said guide in its raised position engages the edges of said bottom opening in said guide sleeve and said top opening in said housing means.

6. An apparatus according to claim 5, wherein:

said article breaking member is a plunger having a pointed lower end;

and said means for raising and lowering said article breaking member is a manually operated crankshaft mechanism rotatably mounted on said stand.

7. An apparatus according to claim 1, wherein said means for raising and lowering said article breaking member is a manually operated crankshaft mechanism rotatably mounted on said stand.

* * * * *